US010428533B2

(12) United States Patent
Magnusson

(10) Patent No.: US 10,428,533 B2
(45) Date of Patent: Oct. 1, 2019

(54) WALL PANEL SYSTEM

(71) Applicant: Natalie A. Magnusson, Schofield, WI (US)

(72) Inventor: Natalie A. Magnusson, Schofield, WI (US)

( * ) Notice: Subject to any disclaimer, the term of this patent is extended or adjusted under 35 U.S.C. 154(b) by 55 days.

(21) Appl. No.: 15/599,723

(22) Filed: May 19, 2017

(65) Prior Publication Data

US 2018/0334810 A1 Nov. 22, 2018

(51) Int. Cl.
*E04F 13/08* (2006.01)

(52) U.S. Cl.
CPC ..... *E04F 13/0894* (2013.01); *E04F 13/0885* (2013.01); *E04F 2201/026* (2013.01); *E04F 2201/07* (2013.01)

(58) Field of Classification Search
CPC ..... E04F 13/0887; E04F 13/0894; E04F 13/0889; E04F 13/0866; E04F 13/083; E04F 13/0875; E04F 13/14; E04F 13/0896; E04F 13/0898; E04F 13/0885; E04F 2201/026; E04F 2201/07; E04F 2201/021; B32B 3/02; B32B 3/04; B32B 3/06; B32B 3/08
USPC ..... 52/392, 309.17, 309.1, 309.4, 302.1, 52/302.4, 302.6, 741.4, 220.2, 220.3, 52/238.1, 405.1, 591.1, 592.6, 489.1, 591
See application file for complete search history.

(56) References Cited

U.S. PATENT DOCUMENTS 2,257,048 A * 9/1941 Fulbright ..... E04F 15/04 52/591.1
2,638,430 A * 5/1953 Mann ..... B29C 63/48 156/270
2,914,815 A * 12/1959 Alexander ..... E04F 15/04 52/177
3,270,473 A * 9/1966 Smith ..... E04F 13/0887 428/49
3,535,844 A * 10/1970 Glaros ..... E04C 2/296 52/309.9
3,730,309 A * 5/1973 Hamann ..... A45C 5/00 190/127
3,866,267 A * 2/1975 Poletti ..... A47G 27/025 16/8
3,881,980 A * 5/1975 Olson ..... B29C 44/5627 156/268
4,003,174 A * 1/1977 Kotcharian ..... B63B 25/16 52/391
4,079,568 A * 3/1978 Wortman ..... A41D 31/02 53/432

(Continued)

*Primary Examiner* — Kyle J. Walraed-Sullivan
(74) *Attorney, Agent, or Firm* — Boyle Fredrickson, S.C.

(57) ABSTRACT

A decorative wall system is provided that includes a number of panels that can be secured to an underlying wall and to one another in an overlapping configuration to provide a multi-layer, three-dimensional appearance to the wall. In one embodiment of the wall system, the system includes individual panels that include a decorative front surface and a rear surface. The rear surface includes undercuts along each side of the rear surface that can be positioned over the side edges of the front surface of an adjacent wall panel. The panels may each include an adhesive layer including compressible strings therein that assist the adhesive in holding the panel on a surface by forming a vacuum between the panel and the surface to which the panel is attached.

14 Claims, 2 Drawing Sheets

(56) References Cited

U.S. PATENT DOCUMENTS 4,107,887 A * 8/1978 Wendt ..... E04B 1/86 52/105
4,156,054 A * 5/1979 Gurewitsch ..... B29C 65/00 428/583
4,242,390 A * 12/1980 Nemeth ..... E04F 15/02 428/189
4,489,115 A * 12/1984 Layman ..... E01C 13/08 156/258
4,649,069 A * 3/1987 Tone ..... A47G 27/0293 428/45
4,766,022 A * 8/1988 Tone ..... A47G 27/0293 428/62
5,103,614 A * 4/1992 Kawaguchi ..... E04F 15/022 52/392
5,390,720 A * 2/1995 Colson ..... B31D 3/0215 160/84.07
5,590,500 A * 1/1997 McCue ..... A47B 96/18 52/311.2
5,673,524 A * 10/1997 Gailey ..... B32B 3/06 52/309.9
5,891,282 A * 4/1999 Stough ..... B32B 29/02 156/71
6,037,033 A * 3/2000 Hunter ..... B32B 3/28 428/72
6,130,268 A * 10/2000 Murray ..... C08G 18/10 521/131
6,308,485 B1 * 10/2001 Blumenthal ..... E04B 9/04 52/460
6,453,632 B1 * 9/2002 Huang ..... E04F 15/04 52/385
6,630,041 B1 * 10/2003 Reiber ..... B44C 1/28 156/63
7,121,059 B2 * 10/2006 Pervan ..... E04F 15/04 52/592.2
7,987,648 B1 * 8/2011 Ryan ..... E04F 13/0846 52/235
8,096,093 B1 * 1/2012 Poon ..... E04F 13/0887 52/311.1
8,898,963 B1 * 12/2014 Amatruda ..... E04D 1/26 52/409
9,611,654 B2 * 4/2017 Dao ..... E04F 15/18
10,024,065 B2 * 7/2018 Balmer ..... E04F 15/107
2006/0174556 A1 * 8/2006 Kornfalt ..... B27N 7/005 52/181
2007/0062153 A1 * 3/2007 Li ..... B32B 3/06 52/796.1
2007/0245662 A1 * 10/2007 Stanchfield ..... E04D 1/365 52/459
2008/0138560 A1 * 6/2008 Windmoller ..... B32B 3/02 428/46
2009/0107076 A1 * 4/2009 Kim ..... E04F 15/02 52/582.1
2010/0110622 A1 * 5/2010 Sun ..... B32B 3/266 361/679.01
2010/0205889 A1 * 8/2010 Anderson ..... E04F 15/02 52/588.1
2010/0223872 A1 * 9/2010 Taylor ..... C09J 7/38 52/309.3
2010/0236171 A1 * 9/2010 Liu ..... E04F 15/02 52/309.3
2010/0288115 A1 * 11/2010 Pfister ..... F41H 5/0428 89/36.02
2011/0003110 A1 * 1/2011 Heartsfield ..... E04F 15/02 428/99
2011/0061328 A1 * 3/2011 Sandy ..... A47G 27/0481 52/582.1
2011/0111176 A1 * 5/2011 Chiu ..... B32B 3/02 428/157
2012/0096798 A1 * 4/2012 Ko ..... E04F 15/02 52/578
2012/0151861 A1 * 6/2012 Mulhair ..... E04F 13/083 52/506.05
2012/0304572 A1 * 12/2012 Aboukhalil ..... E04F 13/0733 52/489.1
2013/0122234 A1 * 5/2013 Gremion ..... B32B 3/06 428/44
2013/0202841 A1 * 8/2013 Kompe ..... B32B 3/02 428/76
2013/0255174 A1 * 10/2013 Stafford ..... E04F 13/0894 52/539
2014/0260061 A1 * 9/2014 Knox ..... E04F 13/0876 52/592.1
2015/0291852 A1 * 10/2015 Yamamoto ..... B32B 3/30 428/41.8
2015/0376840 A1 * 12/2015 Shih ..... D21H 21/22 162/101
2016/0010341 A1 * 1/2016 Deangelis ..... E04F 13/0885 52/389
2016/0168864 A1 * 6/2016 Ramachandra ..... B32B 37/1207 52/588.1
2016/0244978 A1 * 8/2016 Cheng ..... E04F 15/02133
2017/0198714 A1 * 7/2017 Lin ..... B32B 5/02
2017/0232700 A1 * 8/2017 Lemieux ..... B32B 3/02 428/71
2018/0065337 A1 * 3/2018 Grasso ..... B32B 15/04
2018/0179754 A1 * 6/2018 Karnicki ..... E04B 2/70
2018/0223544 A1 * 8/2018 Campbell ..... E04F 15/187

* cited by examiner

WALL PANEL SYSTEM

FIELD OF THE INVENTION

The present invention relates to coverings for walls, and more specifically to a system of panels for use as a wall covering.

BACKGROUND OF THE INVENTION

In order to cover existing wall structures to provide an aesthetically pleasing appearance, many different types of panels have been developed. While the outer surfaces of the panels can have various shapes, configurations an textures in order to provide the desired appearance to the walls over which the panels are positioned, prior art panels are ach formed with a flat rearward surface in order to enable the panel to be positioned flush with the wall surface.

Further, in order to enable adjacent panels to be positioned in an abutting relationship with regard to each other, and thus provide a relatively seamless appearance to the panels when placed on the wall, the panels include various attachment components or structures on the panels that are engageable with one another to secure the panels to each other in this configuration.

In many embodiments, the panels are placed in abutment with one another and are affixed to the wall in a suitable manner, such as by a mechanical fastener engaged through the panel and into the underlying wall. In other embodiments, the engagement structure takes the form of overlapping side portions on one panel that are engaged in a suitable manner with an aligned underlapping portion on the side of an adjacent panel. In this configuration, the panels are secured to one another along their adjacent sides, such that the panels form a secure and relatively seamless structure over the wall on which they are positioned.

However, with these prior art wall panel structures, because the panels are secured to the wall and/or to one another, the prior art panels are limited to having a single exposed surface formed by the panels on the wall. While the single exposed surface can have multiple configurations or textures, the placement of the prior art panels on the wall in the abutting configuration limits them to a single exposed surface across each of the panels.

As a result, it is desirable to develop a decorative wall panel system that enables the individual panels to be secured to the underlying wall in a manner that allows the panels to provide multiple exposed surfaces or a multi-layer configuration on the wall.

SUMMARY OF THE INVENTION

According to one aspect of an exemplary embodiment of the invention, a decorative wall system is provided that includes a number of panels that can be secured to an underlying wall and to one another in an overlapping configuration to provide a multi-layer, three-dimensional appearance to the wall. In one embodiment of the wall system, the system includes individual panels that include a decorative front surface and a rear surface. The rear surface includes undercuts along each side of the rear surface that can be positioned over the side edges of the front surface of an adjacent wall panel. Between the undercuts, the rear surface includes an adhesive for securing the rear surface of the panel to the wall or to another panel to form the decorative wall system.

According to another exemplary embodiment for the invention, the adhesive include compressible strings positioned therein that are thicker than the adhesive and form channels between the strings where no adhesive is present. The adhesive is present over the strings such that the strings are adhered to the wall or other surface by the adhesive, but the channels formed between the strings creates a vacuum or suction force between the adhesive and the surface to which the panel is secured that assists the adhesive in holding the panel on the surface.

Numerous other aspects, features and advantages of the present invention will be made apparent from the following detailed description taken together with the drawing figures.

BRIEF DESCRIPTION OF THE DRAWING FIGURES

The drawings illustrate the best mode currently contemplated of practicing the present invention.

DETAILED DESCRIPTION OF THE DRAWING FIGURES

Figure 1:
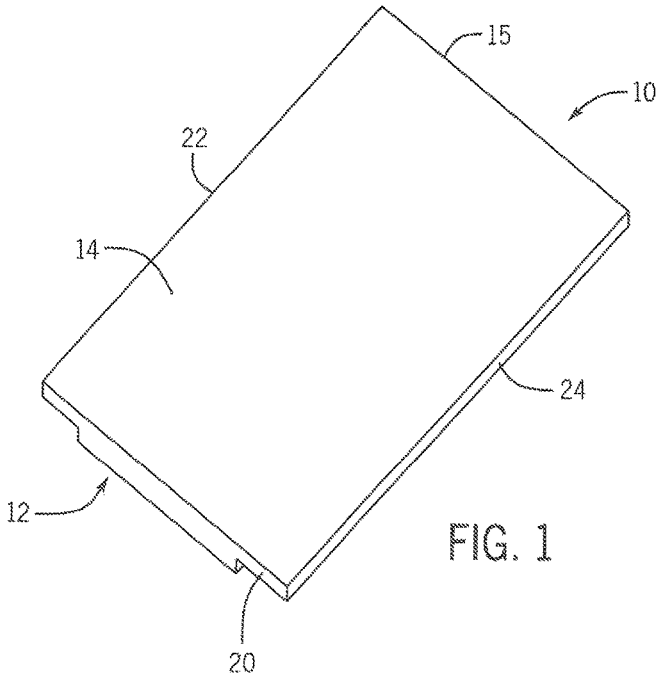
FIG. 1 is an isometric view of a wall panel according to an exemplary embodiment of the invention.

With reference now to the drawing figures in which like reference numerals designate like parts throughout the disclosure, a wall panel for use in a wall panel system is illustrated generally at 10 in FIG. 1. The all panel 10 can be formed of any desired material, such as a wood material, a ceramic material a metal material, a laminate material, or any combination thereof. Each panel 10 includes a body 12 having a front surface 14 and a rear surface 16, each of the front surface 14 and the rear surface 16 bounded by a pair of opposed end edges 18,20 and a pair of side edges 22,24.

Figure 2:
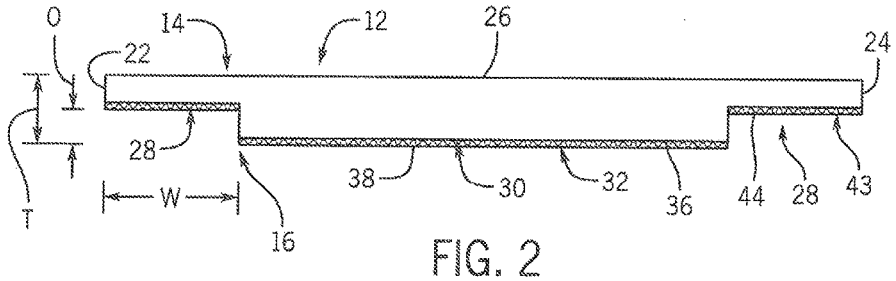
FIG. 2 is a side plan view of the wall panel of FIG. 1.

Referring now to FIG. 2, in the exemplary embodiment the front surface 14 includes a decorative layer, treatment or other material 26 thereon in order to provide the desired appearance for the wall panel 10. The decorative layer 26 extends over the side edges 22,24 in order to completely cover the exposed areas of the wall panel 10.

The rear surface 16 of the panel 10 includes a pair of recessed portions or cutouts 28 located along the side edges 22,24 of the panel 10. In the exemplary illustrated embodiment, though other lengths are also contemplated as being within the scope of the invention, the cutouts 28 extend along the entire length of the panel 10 and extend into the panel 10 from the rear surface 16 towards the front surface 14 a distance D less than the thickness T of the panel 10, such that the cutouts 28 do not affect the decorative layer 26. In one exemplary embodiment, the thickness of the cutout 28 is approximately equal to the thickness of the front surface 14 positioned over the cutouts 28. The cutouts 28 also extend into the body 12 of the panel 10 a width W.

The cutouts 28 define a central portion 30 of the rear surface 16 that includes an attachment layer 32 thereon. The attachment layer 32 can be formed in any suitable manner and of any suitable material in order to secure the central portion 30 of the rear surface 16 to a wall 34, and in an exemplary embodiment is formed of an adhesive layer 36. The adhesive layer 36 can be covered by a suitable release liner 38 to prevent premature adherence of the panel 10 to and adjacent panel 10, the wall 34 or other surface.

Figure 3:
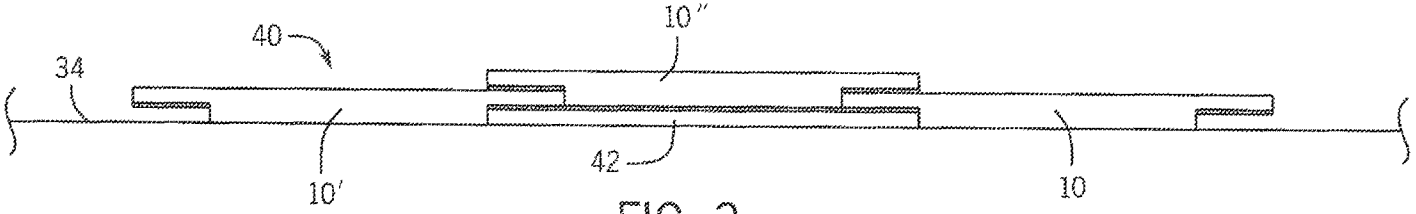
FIG. 3 is a side plan view of a number of wall panels secured to a wall surface according to one exemplary embodiment of the invention.
Figure 4:
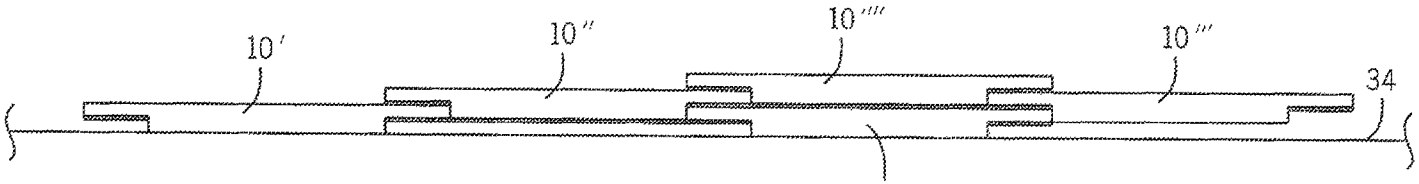
FIG. 4 is a side plan view of a number of wall panels secured to a wall surface according to another exemplary embodiment of the invention.

Looking now at FIGS. 3-4, to assemble the wall panels 10 into a wall panel system 40, initially a first panel 10 is disposed on the wall 34 by removing the release liner 38 from the adhesive 36 on the central portion 30 and pressing the adhesive 36 against the wall 34. A second panel 10' is subsequently placed on the wall 34 with the side edge 24 spaced from the side edge 22 of the first panel 10 a distance approximate to the width of the central portion 30 of the panels 10. A third panel 10" can then be placed between the first panel 10 and the second panel 10' with the central portion 30 of the third panel 10" positioned between the side edges 22 and 24 of the first panel 10 and second panel 10'. Also, the cutouts 28 of the third panel 10 rest against the side edges 22 and 24 of the first panel 10 and second panel 10', in order to provide a stacked, two layer and three-dimensional appearance to the wall panel system 40. Further, in other exemplary embodiments, the cutouts 28 can also include an attachment layer 43, such as an adhesive 44, that contacts the front surface 14 of the first and second panels 10 to secure the cutouts 28 of the third panel 10" to the first panel 10 and second panel 10'.

Figure 5:
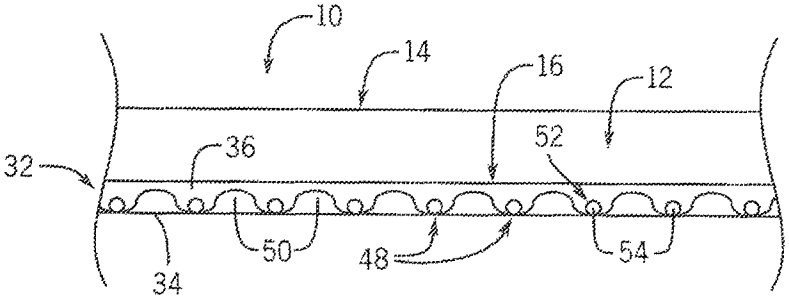
FIG. 5 is a partially broken away cross-sectional view of another embodiment for the wall panel of FIG. 2.

To assist in adhering the rear surface 16 to the wall 34 and/or another panel 10, in the exemplary embodiment of FIG. 5, the attachment surfaces or layers 32, 43 can have ridges or lines 48 formed therein. The ridges 48 extend the length of the rear surface 16 and/or the cutouts 28 and form channels 50 along the attachment layers 32, 43, with the adhesive 36, 44 disposed within the channels 50 and over the ridges 48. The ridges 48 can be formed in any suitable manner on the panel 10, such as by integrally forming the rear surface 16 and/or cutouts 28 with the ridges 48, or by placing a material 52, such as a string 54 along the surface of the attachment layer 32, 43 to form the ridges 48. In this exemplary embodiment, the strings 54 can be placed on the rear surface 16 and/or cutouts 28 with the adhesive 36,44 subsequently placed over the strings 54, or the strings 54 can be placed within an adhesive layer 36,44 already present on the rear surface 16/cutout 28 to form the ridges 48. The strings 54 have a thickness greater than the thickness of the adhesive layer 36,44, such that the strings 54 protrude outwardly from the adhesive layer 54, but retain an amount of the adhesive 36,44 over the strings 54 for engagement with the wall surface 34 of the adjacent panels 10.

In any exemplary embodiment, to assist in attaching the panel 10, when pressed against the wall 34 or other panel 10, the ridges 48 contact and press the adhesive 36,44 onto the wall 34 or panel 10 to engage the adhesive 36,44 with the wall and/or panel 10. In addition, the channels 50 formed by the ridges 48 create suction or a localized vacuum between the adhesive 36,44 within the channels 50 and the wall 34 or panel 10 which assists in holding the panels 10 in position. While not wishing to be bound by any particular theory, this suction is believed to be created in the channels 50 between the panel 10 and the wall 32 by the compression of the strings 54 against the wall 32. This compression effectively seals off the channels 50 from the one another and from the periphery of the panel 10, as the adhesive 36,44 placed along the periphery of the panel 10 securely engages the wall 32 and/or adjacent panel 10 to prevent material from being disposed between the panel 10 and the wall 32 other than the adhesive 36,44 and the strings 54. As such, the air within the channels 50 upon initial pressing of the panel 10 against the wall 32 and/or another panel 10 can be pressed out of the channels 50 past the adhesive 36,44 as the strings 54 are compressed against the panel 10 and/or wall 10. As the strings 54 are compressed further during pressing of the panel 10 against the adjacent panel 10 and/or wall 32, the air becomes exhausted from within the channels 50 as the adhesive 36,44 along the periphery of the panel 10 is engaged with the adjacent panel 10 and/or wall 32. Subsequently, when pressure on the panel 10 is released the strings 54 expand concurrently enlarging the channels 50 between the strings 54. However, due to the lack of air within the channels 50 as air cannot be reintroduced into the channels 50 through the adhesive 36,44 engaged with the adjacent panel 10 and/or wall 32, the expansion of the strings 54 enlarging the channels 50 creates a vacuum in the channels 50 which acts to provide suction between the panels 10 and the adjacent panel 10 and/or wall 32, thereby assisting the adhesive 36,44 in holding the panel 10 in secure engagement with the adjacent panel 10 and/or wall 32.

In other alternative exemplary embodiments, as shown in FIG. 4, a fourth panel 10''' can be placed over the opposite side edge 24 of the first panel 10, to define a space 42 over the first panel 10 between the third panel 10" and fourth panel 10'''. In this embodiment, the space 42 corresponds to the size of the central portion 30 of each of the panels 10, such that a fifth panel 10"" can be positioned within the space 42 between the third panel 10" and fourth panel 10'''. The fifth panel 10"" can also be configured to have a length shorter than other panels 10, 10', 10", 10''' in the system 40, such that the fifth panel 10"" allows a portion of the first panel 10 to be seen, thus forming a stacked, three layer and three-dimensional configuration for the wall system 40.

Various alternative embodiments are also contemplated as being within the scope of the following claims, particularly pointing out and distinctly claiming the subject matter regarded as the invention.

I claim:

1. A method of assembling a decorative wall panel system, the method comprising the steps of:

a. providing a plurality of wall panels, each wall panel of the plurality of wall panels having, body with a front surface, a rear surface, and a pair of cutouts on opposed sides of the rear surface of the body, the pair of cutouts defining a central portion of the rear surface; and b. placing the plurality of wall panels on a wall surface in a stacked, three-dimensional configuration, wherein the step of placing the plurality of wall panels on the wall surface comprises the steps of:

i. placing a first wall panel on the wall surface;

ii. placing a second wall panel on the wall surface spaced from the first panel;

iii. placing a third wall panel on the wall surface between the first wall panel and the second wall panel such that the central portion of the third wall panel is positioned between and abutting each of the first wall panel and the second wall panel to define and open space between the wall surface and the central portion of the third wall panel; and wherein the step of placing the third wall panel on the wall surface comprises placing the pair of cutouts of the third panel over adjacent sides of the first and second wall panels.

2. The method of claim 1 wherein the central portion includes an attachment layer thereon and wherein the step of placing the plurality of wall panels on the wall surface comprises a step of engaging the attachment layer with the wall surface.

3. The method of claim 2 wherein the attachment layer is an adhesive layer and the step of engaging the attachment layer with the wall surface comprises adhering the attachment layer to the wall surface.

4. The method of claim 1 wherein the pair of cutouts include attachment surfaces thereon and wherein the step of placing the pair of cutouts of the third panel over the sides of the first and second panels comprises engaging the attachment surfaces on the pair of cutouts with the opposed sides of the first and second panels.

5. The method of claim 1 wherein the step of placing the second panel on the wall surface spaced from the first panel comprises placing the second panel on the wall surface at a distance between adjacent sides of the first and second panels equal to a width of the central portion of a wall panel.

6. The method of claim 2 wherein the attachment layer includes a plurality of spaced ridges thereon that define channels therebetween, and wherein the step of engaging the attachment layer with the wall surface comprises forming a vacuum between the plurality of spaced ridges and the wall surface within the channels.

7. The method of claim 1 wherein the open space defined between the wall surface and the central portion of the third wall panel consists of empty space.

8. A wall panel system for placement on a wall surface, the wall panel system comprising:

a. a first wall panel having a body with a front surface, a rear surface, and a pair of cutouts on opposed sides of the rear surface of the body, the pair of cutouts defining a central portion of the rear surface;

b. a second wall panel having a body with a front surface, a rear surface, and a pair of cutouts on opposed sides of the rear surface of the body, the pair of cutouts defining a central portion of the rear surface; and c. a third wall panel having a body with a front surface, a rear surface, and a pair of cutouts on opposed sides of the rear surface of the body, the pair of cutouts defining a central portion of the rear surface, wherein the central portion of the third wall panel is disposed between and in engagement with adjacent sides of the first wall panel and the second wall panel to define an open space between the wall surface and the central portion of the third wall panel, wherein the first, second and third wall panels are placed on the wall surface in a stacked, three-dimensional configuration, wherein the pair of cutouts of the third panel are disposed over the adjacent sides of the first and second wall panels.

9. The wall panel system of claim 8 further comprising an open space defined between the wall surface and the central portion of the third wall panel that consists of empty space.

10. The wall panel system of claim 8 further comprising attachment surfaces on the pair of cutouts of the first, second and third wall panels.

11. The wall panels system of claim 10 wherein the attachment surfaces include ridges formed thereon that define channels therebetween.

12. The wall panel system of claim 8 further comprising attachment layers on the central portions of the first, second and third wall panels.

13. The wall panel system of claim 12 wherein the attachment layer comprises:

an adhesive layer; and a plurality of strings positioned within the adhesive layer, each of the plurality of strings having a thickness greater than the thickness of the adhesive layer.

14. The wall panel of claim 13 wherein the plurality of strings are compressible in order to form a vacuum between the plurality of strings when the wall panel system is pressed against a surface.

* * * * *